United States Patent [19]

Tredwell

[11] 4,181,093

[45] Jan. 1, 1980

[54] SPRAYING SYSTEM WITH IMPROVED EXHAUST

[75] Inventor: Gilman Tredwell, Evansville, Ind.

[73] Assignee: George Koch Sons, Inc., Evansville, Ind.

[21] Appl. No.: 893,998

[22] Filed: Apr. 6, 1978

[51] Int. Cl.[2] ..... B05C 15/00

[52] U.S. Cl. ..... 118/323; 118/326; 118/DIG. 7

[58] Field of Search ..... 118/DIG. 7, 326, 323, 118/634; 98/115 SB

[56] References Cited

U.S. PATENT DOCUMENTS

| | | | |
|---|---|---|---|
| 3,902,455 | 9/1975 | Lehmann et al. | 118/DIG. 7 |
| 3,918,641 | 11/1975 | Lehmann et al. | 118/634 X |

FOREIGN PATENT DOCUMENTS

| | | | |
|---|---|---|---|
| 828032 | 1/1952 | Fed. Rep. of Germany | 98/115 SB |

*Primary Examiner*—John P. McIntosh

*Attorney, Agent, or Firm*—Jenkins, Coffey, Hyland, Badger & Conard

[57] ABSTRACT

A spraying system for applying a coating to articles includes a spray booth having a back, a reciprocating spray gun, and an exhaust fan to pull atmosphere from within the spray booth through said back to collect undeposited spray coating material and to exhaust solvent vapors released within the spray booth. The back is movable and has a vent opening having an area substantially smaller than the area of the back, the remainder of the back being impervious to booth atmosphere. The spraying system also includes means for reciprocating the movable back in synchronism with the reciprocating spray gun so that said vent opening is maintained directly before the spray gun during operation.

7 Claims, 2 Drawing Figures

SPRAYING SYSTEM WITH IMPROVED EXHAUST

Figure 1:
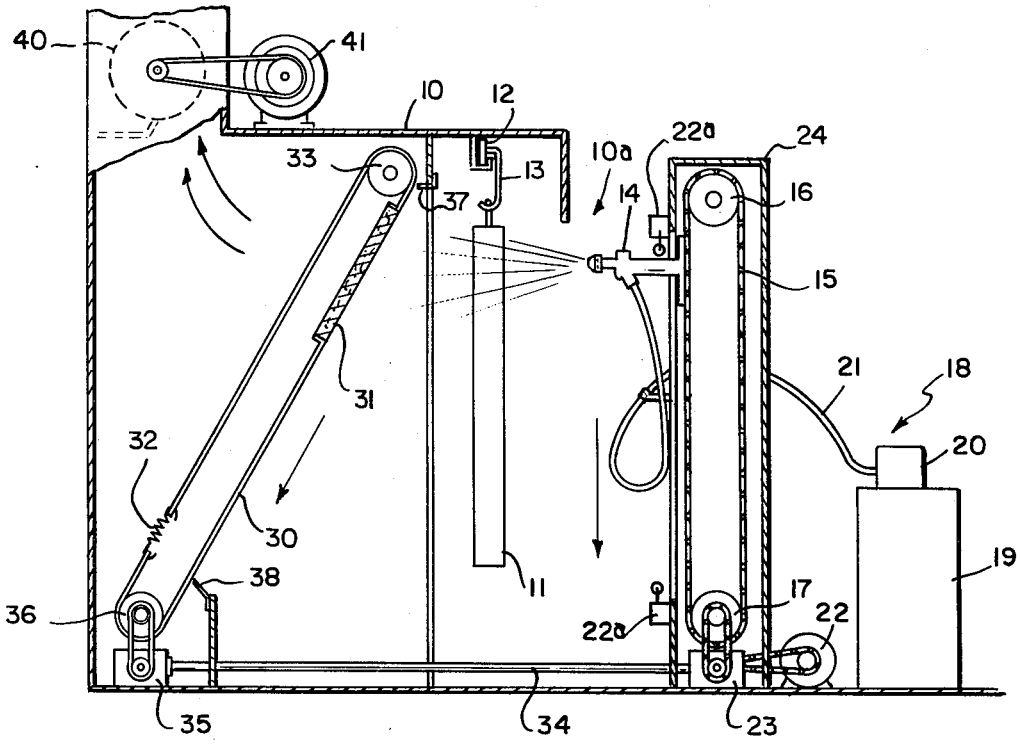

The invention is directed to a system for coating articles, and more particulaly to a spraying system including a reciprocating spray gun and a back wall movable in synchronism with the gun. The back wall includes a relatively small vent opening which stays generally in front of the gun during spraying operations to reduce the need for make-up air and the energy required to heat or cool the make-up air.

In spray coating systems, it is necessary to provide reciprocating spray guns in order to coat articles having dimensions greater than the extent of the spray pattern from the spray gun. In such systems, the elongated articles to be coated are conveyed past one or more spray guns which may be reciprocated, generally in a vertical plane, to provide a directed sray of coating material at the entire extent of the elongated articles. Since many coating materials and the vapors of solvents emitted from such coating materials are flammable, fire prevention codes generally require that spray operations take place within the confines of a spray booth, and the reciprocating spray gun and the article are generally enclosed in a spray booth to confine in the interior of the spray booth, particles of coating material spray which are not deposited upon the article and also to confine solvent vapors released from the coating material as it is being sprayed. It is necessary, however, to have a ventilating system to provide removal of the released solvent vapors from the spray booth to prevent their reaching levels at which they would form a readily ignitable mixture with air and to further provide for a flow of air into the spray booth through the openings by which the articles enter to prevent the escape through such openings of undeposited spray particles and released solvent vapors.

In prior spraying systems, the entire back wall of the spray booth was generally comprised of filters and the spray booth ventilation system exhausted the spray booth atmosphere from the spray booth through the filters at the back wall. Another common system of collecting undeposited spray particles consisted of the so-called "water-wash" spray booth in which the entire back wall was comprised of water flowing downwardly over panels forming the back of the spray booth and at which the spray from the spray gun were directed.

The spraying system of this invention is a substantial improvement over these prior spraying systems. In the spraying system of this invention, only a portion of the back wall of the spray booth constitutes a filter. The size of this filter is generally selected to be about equal to the size of the spray pattern from the spray gun as it impinges upon the back wall of the booth. This relatively small filter forms part of a movable back surface of the spray booth with the remainder of the movable back surface of the spray booth being impervious to booth atmosphere. The relatively small filter and the movable back surface of the spray booth are arranged to reciprocate in synchronism with the reciprocating spray gun in such a manner that the spray from the spray gun is at all times directed at the filter. With the area of the filter at the back of the spray booth substantially reduced and maintained directly in the predominant path of the spray, more effective use of the exhaust and energy savings can be achieved. The velocity of the exhaust through the smaller filter can be increased substantially, increasing the tendency of the undeposited spray particles to be caught up in the exhaust and carried into the filter, and a substantially reduced volume of exhaust is needed for effective collection of undeposited coating material and removal of the released solvent vapors. The volume of make-up air made necessary because of the use of spraying systems of this invention is therefore substantially reduced, and this reduces the energy used in heating the make-up air during winter and in cooling the make-up air during summer.

Figure 2:
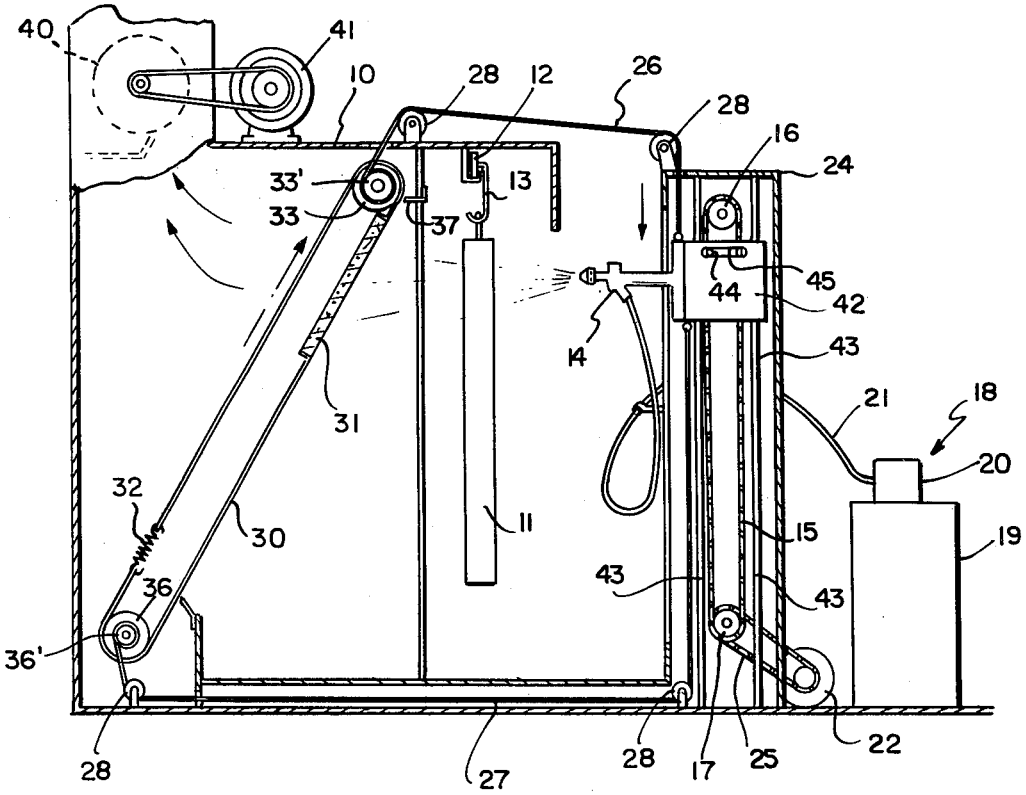

The invention will be more fully understood from the following detailed description and the attached drawings in which FIG. 1 is a cross sectional view of one embodiment of the spraying system of this invention; and FIG. 2 is a cross sectional view of another embodiment of a spraying system of my invention.

FIG. 1 illustrates a spray system incorporating the invention. The system includes a spray booth 10 to enclose the spraying operations. A plurality of elongated articles 11 are carried through the spray booth 10, for example, by an overhead conveyor 12. The articles 11 are carried on the overhead conveyor by a plurality of work hangers 13. As the articles 11 are carried through the spray booth 10, they are coated by spray directed from a spray gun 14 at the articles 11 and at the back of the spray booth 10. Because, as shown in FIG. 1, the articles 11 have a height greater than the extent of the spray pattern from spray gun 14, spray gun 14 is reciprocated vertically as the articles 11 pass through the spray booth 10. The spray gun 14 is mounted on a chain drive 15 which passes over an idler sprocket 16 at the top and a driven sprocket 17 at the bottom. Coating material is delivered to the spray gun 14 by source of coating material 18, typically including a coating material container 19 and a pump 20. The source of coating material 18 is connected to the spray gun 14 through an elongated flexible hose 21. Motor 22 is mechanically coupled to a transmission 23 which in turn is mechanically coupled to the driven sprocket 17 to provide the motive power to reciprocate spray gun 14 by means of chain drive 15. The chain drive 15, sprocket 16 and 17 and transmission 23 are all enclosed by a protective enclosure 24.

Part of the back wall of the spray booth 10 is comprised of a movable portion 30 carrying a filter 31. Filter 31, as shown in FIG. 1, has a size approximately equal to the size of the spray pattern from spray gun 14 at the approximate average distance of the filter 31 from the spray gun 14. The spray pattern from spray gun 14 expands substantially as the distance from the spray gun 14 is increased. Although it is not shown in the cross sectional view of the spraying system in FIG. 1, the size of the filter 31 horizontally in the dimension not shown is also substantially equal to the size of the spray pattern from spray gun 14. The movable back portion 30 of spray booth 10 other than filter 31 is impervious to the spray booth atmosphere. The portion 30 may be comprised of a solid flexible belt material which is resistant to the destructive effects of the coating material being sprayed and the solvents used in such coating material. Examples of such web-like material can include thin metal sheet, thin thermoplastic sheeting or other such materials. As shown in FIG. 1, the portion 30 comprises a moving flexible belt of such material that can be tensioned by spring means 32 around an idler roller 33 fastened adjacent the top of the spray booth.

The filter 31 can be driven in synchronism with spray gun 14 by rotating axle 34 which mechanically couples transmission 23 of the spray gun reciprocator drive and transmission 35 of the filter reciprocator drive. A driven roller 36 over which the moving web 30 passes is mechanically interconnected to and driven by transmission 35.

In this system, motor 22 can be controlled to provide motive power in two directions by reversal of the direction of rotation of the motor through controls in a manner known in the art and through the use of reversing switches 22*a* at the top and bottom of the reciprocator stroke. But preferably, such reversal of direction of the reciprocator drives for the spray gun 14 and the filter 31 can be provided through control of transmission 23 and the shifting of gears therein by electrically operated solenoids in a manner known in the art. Through the interconnection of axle 34 and the actions of transmissions 23 and 35, motive power from motor 22 can be applied to spray gun 14 and filter 31 so that they are driven in the same direction and at the same rate of speed and reversed in the direction of travel at the same time. With such a system, filter 31 is maintained directly before spray gun 14.

At the very rear of spray booth 10, a blower 40 driven by a blower motor 41 pulls the atmosphere within spray booth 10 through filter 31 to collect undeposited particles of coating material on filter 31 and to remove from the spray booth 10, the vapors of solvents released in the operation of spray gun 14.

With filter 31 maintained directly in the predominant path of the spray, the exhaust through the filter can most effectively control undeposited spray particles and the solvent vapor released from the coating material during spraying operations. In order to prevent bypassing of filter 31, flexible seals 37 and 38 are provided against portion 30 of the movable back wall of the spray booth. Filter 31 is preferably replaceable.

Exhaust from the spray booth 10 created by the action of blower 40 must be made up by an inflow of fresh air through the opening 10*a* of the spray booth. It is necessary to remove the solvent vapors from the interior of spray booth 10 to outside of the plant because of their flammability and, in some cases, the toxicity of the solvent vapors. Air entering the spray booth 10 must be made up from outside of the plant to avoid negative pressure between the plant and the outside environment and must be either heated or cooled to maintain atmospheric conditions within the plant. Because filter 31 is substantially smaller than the entire back wall of spray booth 10, the volume of air that is exhausted from the spray booth is substantially reduced, and the volume of make-up air resulting from operation of the spraying system is correspondingly reduced thereby reducing the amount of energy needed to heat and cool the make-up air.

FIG. 2 is a cross sectional schematic view of another embodiment of the spraying system of this invention. In the system shown in FIG. 2, spray booth 10 is substantially like spray booth 10 of FIG. 1. A plurality of elongated articles 11 are carried through the spray booth 10 on overhead conveyor 12 suspended by work holders 13. Spray gun 14 is reciprocated by chain drive 15 passing over idler sprocket 16 and driven sprocket 17. Coating material is delivered to spray gun 14 through an elongated flexible hose 21 from a source of supply 18 comprising a coating material container 19 and pump 20. As in the system shown in FIG. 1, a portion of the back of the spray booth 30 is movable and carries a filter 31, which is preferably removable. The portion 30 is the same of portion 30 of FIG. 1 and is preferably a material impervious to the flow of the atmosphere making up the booth. The belt-like portion 30 may be tensioned by a spring 32 over rollers 33 and 36.

The drawings show the spring 32 connecting the opposite ends of the belt-like portion and holding the portion in tension. It will be appreciated that there is considerable space between the opposite ends of the portion 30 and that the spring 32 will not close this space. Thus, the blower 40 which draws air through the filter 31 draws the air through the space between the opposite ends of belt-like portion 30. It will further be appreciated that this space is not closed by the spring 32 and that it moves upwardly and downwardly as the portion 30 moves.

The difference between the spraying systems of FIG. 1 and FIG. 2 lies in the means of driving and synchronizing the reciprocating spray gun 14 and the reciprocating filter 31. In the spraying system of FIG. 2, the motor 22 is coupled to the driving sprocket 17 of the spray gun reciprocating system by, for example, a chain link belt 15. Motive force from motor 22 is transmitted to the movable portion 30 and filter 31 at the back of the spray booth by means of cables 26 and 27 and pulleys 28 and pulleys 33' and 36' that are connected to rollers 33 and 36 respectively. The motor 22 moves the chain drive 15 in the same direction at all times. The spray gun 14 is mounted on a sled 42 that is captured by and travels between rails 43 on rollers (not shown). The sled 42 and spray gun are driven by a driving rod 44 attached to one point on the chain drive 15. The driving rod 44 can be coupled to a slot 45 in the sled 42 and the sled is reciprocated vertically as the driving rod 44 travels endlessly around the chain drive 15. The reciprocating motion of spray gun 14 is coupled to filter 31 by cables 26 and 27 that are connected to sled 42. For example, as sled 42 and spray gun 14 are driven downwardly by driving rod 44, cable 26 is pulled in the direction of spray gun 14 and is unwound from and turns pulley 33' and roller 33 in a clockwise direction as shown in FIG. 2 to move filter 31 downwardly in synchronism with spray gun 14 and maintain the filter 31 directly before spray gun 14. As driving rod 44 of the chain drive 15 passes around the driven pulley 17 at the bottom of its stroke and begins its travel upwardly, it drives sled 42 and spray gun 14 upwardly and cable 27 is pulled in the direction of the spray gun 14 and is unwound from and turns pulley 36' and roller 36 in a direction counterclockwise as shown in FIG. 2, thus moving filter 31 upwardly in synchronism with spray gun 14 and maintaining the filter 31 before the spray gun 14. Movement of the belt 30 over the rollers 33 and 36 rewinds the cables 26 and 27 onto pulleys 33' and 36', respectively, when they are free of tension from sled 42.

Other means of providing synchronized reciprocation of the filter means at the back of the spray booth and the spray gun may be used. Such means can include a pair of cylinders and fluid power sources arranged to provide reciprocation of the pistons of the cylinders and coupled together to maintain synchronism in the reciprocation in a manner known in the art. If room is available, the wall 30 may be a rigid wall slidably driven upwardly and downwardly in synchronism with the gun 14. It is understood, therefore, that such variations from the embodiments illustrated do not depart from the spirit and scope of the invention as set forth in the following claims.

I claim:

1. A spraying system for applying a coating to a plurality of articles comprising a booth having a movable back surface, a movable spray gun, a source of coating material to be sprayed, means for carrying a plurality of articles to be coated through the booth and between the spray gun and the movable back surface, the spray from said spray gun being directed at the articles and the moveable back surface during spraying operations and as the spray gun is moved, the movable back surface having a vent opening, a fan to exhaust atmosphere from the spray booth through said vent opening, and means for moving the movable back surface and gun in synchronism to maintain the vent opening directly before the spray gun during spraying operations.

2. The spraying system of claim 1 including a filter approximately the size of the pattern of the spray from the gun at the movable back surface covering said vent opening.

3. A spraying system for applying a coating to a plurality of articles comprising a spray booth having a movable surface included at its back, a spray gun mounted for reciprocation within the spray booth, a source of coating material to be sprayed, means to carry a plurality of articles to be coated through the spray booth and between the spray gun and the movable back surface of the booth, the spray from said spray gun being directed at the articles and the movable back surface of the booth during spraying operations and as the spray gun is reciprocated, a filter in a portion of the movable back surface of the booth, a blower mounted on said booth behind said movable back surface to exhaust the booth atmosphere through said filter, drive means to reciprocate said spray gun, said drive means being mechanically interconnected to said filter and movable back surface of the spray booth to reciprocate said filter and movable back surface in synchronism with the reciprocating spray gun and maintain the filter directly before the spray gun during spraying operations.

4. In a spraying system for applying a coating to articles including a spray booth having a back, a reciprocating spray gun, and an exhaust fan to pull atmosphere from within the spray booth through said back to collect undeposited spray coating material and to exhaust solvent vapors released within the spray booth, the improvement in which said back is movable and has a vent opening having an area substantially smaller than the area of the back, the remainder of the back being impervious to booth atmosphere, and means for reciprocating said movable back in synchronism with the reciprocating spray gun so that said vent opening is maintained directly before the spray gun during operation.

5. The spraying system of claim 4 wherein the movable back is a movable belt.

6. A spraying system for applying a coating to articles including a reciprocating spray gun, a spray booth, a back surface of the spray booth with a filter having an area substantially the size of the spray pattern from the reciprocating spray gun, the remainder of the movable back surface of the spray booth being impervious to booth atmosphere, said back surface being movable, an exhaust fan to pull atmosphere from within the spray booth through said filter to collect undeposited spray coating material and to exhaust solvent vapors released within the spray booth, and a drive to reciprocate said movable back surface in synchronism with the reciprocating spray gun so that said filter is maintained directly before the spray gun during operation.

7. The spraying system of claim 6 wherein the filter is mounted on a movable belt forming said movable back surface of the spray booth, said belt being reciprocated by said mechanical connection.

* * * * *